310-10 SR
FIP8502 XR 4,093,430

United States Patent [19] [11] 4,093,430
Schwab et al. [45] June 6, 1978

[54] APPARATUS FOR IONIZING GASES, ELECTROSTATICALLY CHARGING PARTICLES, AND ELECTROSTATICALLY CHARGING PARTICLES OR IONIZING GASES FOR REMOVING CONTAMINANTS FROM GAS STREAMS

[75] Inventors: James J. Schwab, Seattle; David B. Goodson, Renton, both of Wash.

[73] Assignee: Air Pollution Systems, Incorporated, Kent, Wash.

[21] Appl. No.: 690,948

[22] Filed: May 28, 1976

Related U.S. Application Data

[62] Division of Ser. No. 498,409, Aug. 19, 1974, abandoned.

[51] Int. Cl.[2] ..... B03C 3/41

[52] U.S. Cl. ..... 55/107; 55/119; 55/120; 55/122; 55/124; 55/138; 55/146; 55/150; 310/10

[58] Field of Search ..... 55/2, 7, 10, 13, 118, 55/119, 120, 122, 124, 130, 140, 146, 150, 154, 107, 138; 261/DIG. 54; 310/6, 10

[56] References Cited

U.S. PATENT DOCUMENTS

| | | | |
|---|---|---|---|
| 1,475,995 | 12/1923 | Heis et al. | 55/150 |
| 2,864,458 | 12/1958 | DeGraaf et al. | 55/154 |
| 2,956,640 | 10/1960 | Tuche et al. | 55/118 |
| 3,395,193 | 7/1968 | Bruce et al. | 55/122 |
| 3,400,513 | 9/1968 | Boll | 55/146 |
| 3,405,291 | 10/1968 | Brandmaier | 55/146 |
| 3,668,835 | 6/1972 | Vicard | 55/124 |
| 3,874,858 | 4/1975 | Klugman et al. | 55/118 |

FOREIGN PATENT DOCUMENTS

| | | | |
|---|---|---|---|
| 1,048,326 | 8/1953 | France | 55/150 |
| 334,786 | 8/1934 | Germany | 55/150 |
| 312,049 | 3/1918 | Germany | 55/150 |
| 351,257 | 2/1961 | Switzerland | 55/150 |
| 375,097 | 5/1973 | U.S.S.R. | 55/120 |

*Primary Examiner*—Frank W. Lutter
*Assistant Examiner*—David L. Lacey
*Attorney, Agent, or Firm*—Seed, Berry, Vernon & Baynham

[57] ABSTRACT

A venturi increases the velocity of contaminated gases and guides the gases past a high, extremely dense electrostatic field presented perpendicular to the gas flow and extending radially outward between a central, accurately sized disc electrode and the surface of the venturi throat. Downstream, charged particles are collected by a wet scrubbing process or electrostatic precipitator.

35 Claims, 17 Drawing Figures

FIG. 1
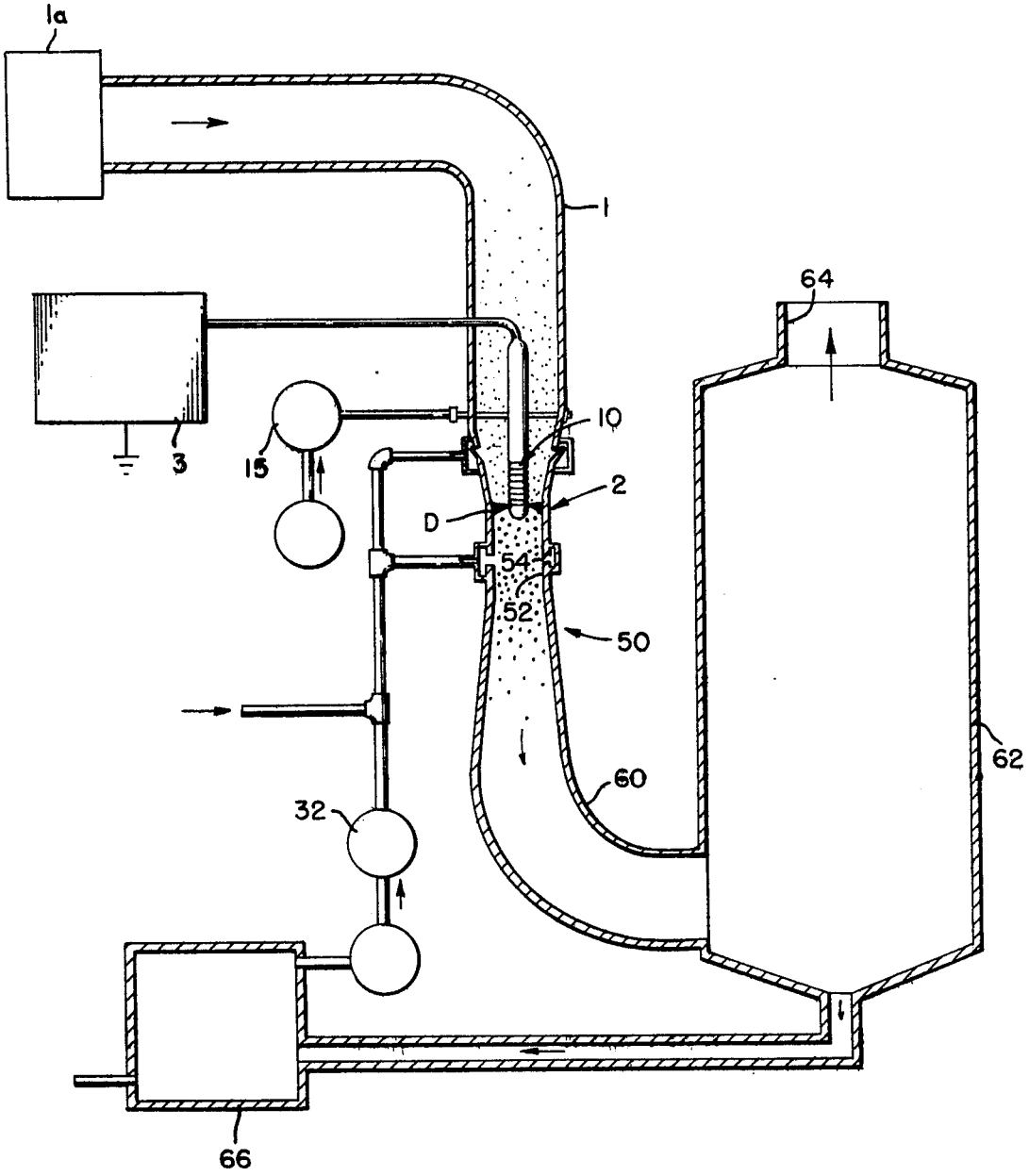
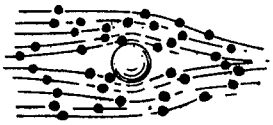
FIG. 1A
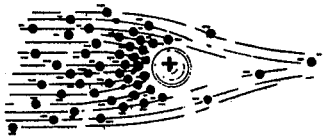
FIG. 1B

APPARATUS FOR IONIZING GASES, ELECTROSTATICALLY CHARGING PARTICLES, AND ELECTROSTATICALLY CHARGING PARTICLES OR IONIZING GASES FOR REMOVING CONTAMINANTS FROM GAS STREAMS

This is a divisional of application Ser. No. 498,409, filed Aug. 19, 1974, now abandoned.

BACKGROUND OF THE INVENTION

1. Field of the Invention

This invention relates to processes and apparatuses for the cleaning of contaminated gases, to processes and apparatuses for ionizing gases or charging particles in fluid streams, and to processes and apparatuses for increasing the efficiency of wire-plate ionizers.

2. Description of the Prior Art

Many industrial processes discharge considerable amounts of atmospheric contaminants as particulates in the sub-micron range. This type of particulate is most difficult to control. Fine particulate emission is becoming a major source of air pollution as the larger particulate problems have been easier to bring under control.

Curently, there are three basic approaches to the problem of handling sub-micron sized particulates in contaminated gases. The first approach is the traditional electrostatic precipitator system. The application of electrostatic precipitators to fine particulate control has several inherent problems.

The second basic type of cleaning system is the wet scrubbing approach. The wet scrubbing approach as applied to the control of fine particulates generally is of the high-energy venturi type. In order to capture the sub-micron particulates in water droplets, large quantities of water must be injected and high relative velocities employed. Both of these factors increase the pressure drop of the system, and operating cost is directly related to this pressure drop.

The third basic type is generally referred to as the dry filter system. A problem with equipment of this type, however, is the temperature limitation of the filter elements, and the related problem of the high cost of reducing this temperature.

Efforts have been made to improve the efficiency of these various techniques by electrostatically precharging the contaminants upstream of the primary collecting system. These efforts have generally been unsuccessful due primarily to the lack of an effective mechanism to produce a continuous, sufficiently intense field to adequately charge and affect the sub-micron sized particles.

Ionizers for charging particles or ionizing gases have heretofore been of the wire-cylinder, wire-plate or needle point type and have been limited to field intensities of about 10 kv/cm average field and low ion density limits of about $10^9$ ions/cm$^3$ in the interelectrode region. As a result, the usefulness and effectiveness of such ionizers have been limited.

SUMMARY OF THE INVENTION

It is the object of this invention to provide a process and apparatus for efficiently removing sub-micron sized contaminants along with the larger particles from contaminated gases such that the gases can be discharged into the atmosphere without accompanying air pollution.

A further objective of this invention is to accomplish the removal of the contaminants with equipment of competitive initial sales price.

A still further objective of this invention is to accomplish the removal of the contaminants with equipment of low installation cost.

A still further objective of this invention is to provide a process and apparatus which will substantially reduce operating costs, both from power consumption and maintenance, and still accomplish the desired removal of sub-micrcon contaminants.

According to one aspect of this invention, these objects are obtained by the method of flowing a gas containing contaminants into a venturi to increase the velocity thereof, exposing the gases in the venturi throat to a high, extremely dense electrostatic field presented perpendicular to the flowing gases and passing through this field at elevated velocity, electrostatically charging the contaminants (particles and, to a lesser extent, ionizing gases) to either a positive or a negative polarity, depending on the nature of the field in the venturi throat, and collecting the charged contaminants.

According to another aspect of this invention, a particularly configured electrode, in the shape of a toroidal surface, is placed at an accurately located distance from an annular outer electrode whose surface is adequately cleaned to prevent charged particle deposition, and contaminant-containing gas is passed through the resulting electric field at a particular velocity to electrostatically charge the contaminants. The electrode configuration, surface cleaning and related gas velocity provide a high-intensity electrostatic field between the electrodes without producing the voltage breakdown normally expected in such a high-voltage field.

The contaminants can be collected by any of several conventional techniques, such as electrostatic precipitation, wet scrubbing or a combination of these techniques, depending on the nature of the particular collection device employed.

Two types of collection devices successfully employed will be discussed.

It is another object of this invention to provide a general purpose ionizer.

It is another object of this invention to provide an ionizer capable of creating extremely high field intensities without spark breakdown.

It is another object of this invention to provide a method and apparatus for charging gas particles in fluid streams or ionizing gases such as for electrical power generation, such as EGD, or for gas phase reactions, respectively.

Basically, these objects are obtained by passing appropriate gas streams through the ionizer at high velocities, with or without cleaning of the outer wall of the venturi, depending on the nature of the gas stream.

It is another object of this invention to provide an improved method and apparatus for increasing the field intensity and ion density of conventional wire-plate ionizers.

Basically, this object is obtained by increasing the velocity of the stream to be ionized as its passes the wire-plate to improve the stability of the corona discharge. Wire-plate, as used herein, also applies to other electrode configurations having a partially linear electrode configuration such that the field does not expand both axially and transversely of the stream path of flow. A race-track electrode configuration with curved ends and linear, parallel sides is one such example.

BRIEF DESCRIPTION OF THE FIGURES OF THE DRAWING

FIG. 1 is a longitudinal section of one embodiment of an apparatus embodying the principles of the invention.

FIGS. 1A and 1B are schematic illustrations of contaminated particle paths in a conventional wet scrubber and in a system highly charged according to the principles of this invention, respectively.

DETAILED DESCRIPTION OF THE PREFERRED EMBODIMENTS

Figure 2:
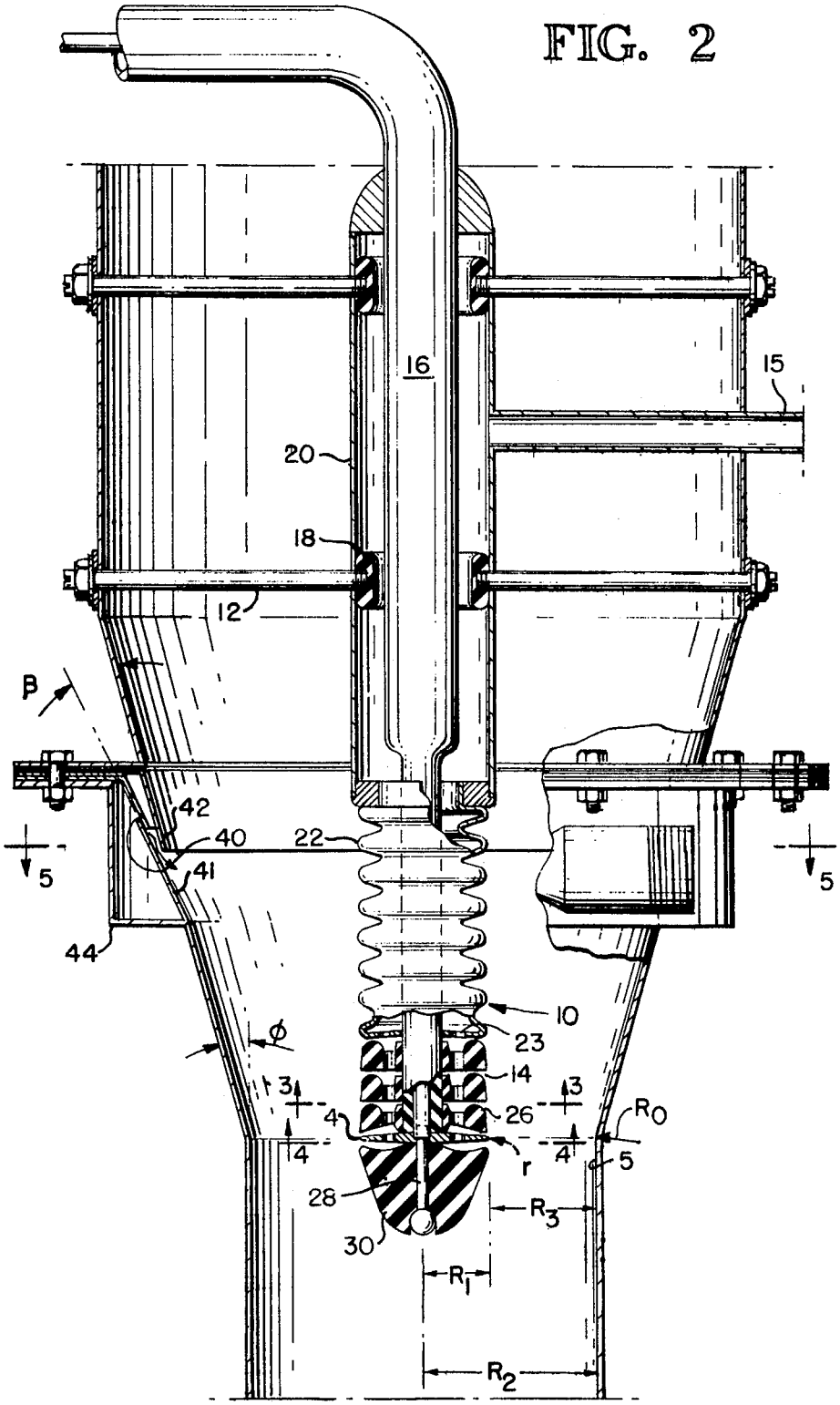
FIG. 2 is a fragmentary, enlarged section of a portion of the apparatus shown in FIG. 1.

Referring to FIG. 1, the gas containing the contaminants is directed through an inlet duct 1 by a blower 1a to the entrance of a gas contaminant-charging venturi section 2. The gases and contaminants are accelerated to an elevated velocity that will be a maximum in the venturi throat. A highly intense corona discharge is maintained in the venturi throat by a high-voltage DC power supply 3. The discharge D propagates from a highly stressed electrode disc 4, centered in the venturi throat, to the outer wall 5 of the venturi in a radial direction. The corona discharge is extremely thin in the direction of the gas flow and, hence, the resident time of the contaminant particles in the electrostatic field is short. A high level of electrostatic charge is imposed on the particles, however, for several unique reasons.

Although an electrode having the shape of a disc is shown and will be described in detail, a toroid, ellipsoid (ring or solid disc) or other configuration having a smooth radial periphery may also be used. Similarly, the outer edge shape of the electrode 4 at the radius *r*, in cross-section as viewed in FIG. 2, need not be circular. Other designs that can be used include, for example, paraboloids, ellipsoids, or wedges with a curved edge radius. See, for example, in FIGS. 10A–10D. It is also possible to use electrodes with serrated edges. The term radial or radius of the edge as used herein is intended to cover all such configurations. [The electrode 4 in the preferred embodiment is electrically isolated by two adjacent dielectric insulators 26 and 28, to be described, which also appear to affect spark breakdown but as yet in an undetermined manner.]

While optimum performance is obtained by centering the inner electrode 4 concentrically within the venturi throat wall 5, it will be understood by one skilled in the art that the apparatus will function effectively with off-center positioning as well.

Furthermore, the venturi wall curvature radius $R_O$ can vary to some extent, but best results are obtained with ratios of above 50:1 relative to the inner electrode edge radius *r*.

The axial location of the electrode 4 within the venturi throat can be varied within limits. Shifting the location upstream increases the gap $R_3$ to reduce the field intensity and requires higher voltage requirements but reduces the velocity of the contaminated gas stream. Reducing velocity both aids and detracts from ionizing efficiency within limits which will be described.

All of the above variations to the preferred illustrated configuration will degrade the performance to some degree; however, many operations or uses of the invention will not be necessary to obtain maximum operating conditions, and more economical construction techniques may suggest the use of one or more variations with acceptably lower ionizing efficiency.

Thus far the invention has been described as an ionizer for use upstream of a contaminant cleaning apparatus, such as a scrubber or precipitator, to substantially increase the efficiency of the cleaning apparatus. The ionizer, however, has other applications as well. For example, it may be used merely to charge particles for electrical power generation, i.e., EGD (electro-gas-dynamic generation), or ionize streams for gas phase reactions, for example, generating atomic oxygen for oxidizing reactions, such as ozone generation for odor removal of sulphur dioxide to sulphur trioxide reactions. In these applications, a gas stream at the velocities described herein is directed past the ionizer in the same manner as the contaminated gas stream; however, surface cleaning of the outer electrode is not necessary if particle deposition does not occur.

Figure 7:
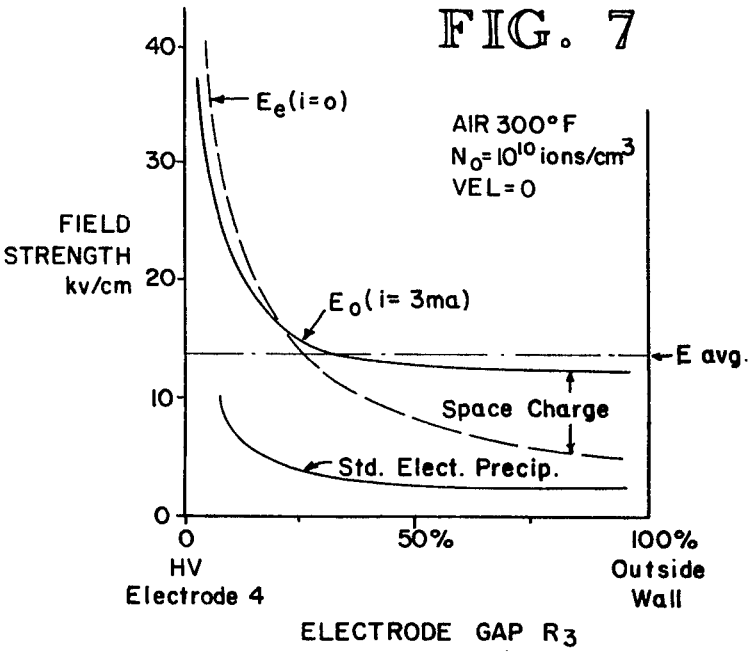
FIG. 7 is a diagram of the electrostatic field between the electrodes of the invention.

The electrostatic field (with corona discharge) Eo sustained between the electrode 4 and outer venturi throat wall 5 is comprised of two elements, an electric field E*e* and a space charge influence, as shown in the chart of FIG. 7. The electric field is related to the applied voltage and the electrode geometry. The space charge influence, comprised of ions, electrons and charged particles in the interelectrode region, is created after corona discharge has been initiated. As shown in FIG. 7, the space charge influence tends to amplify the field in the region closer to the outer venturi throat wall and suppresses the highly intense field closer to the electrode. This effect stabilizes the corona discharge while allowing a high electrostatic field to bridge the entire interelectrode region $R_3$. This is accomplished without spark breakdown by electrode design, maintaining a high velocity in the region and a clean surface on the outer electrode.

Cleaning of the outer electrode surface is necessary only to maintain the surface relatively clean to minimize spark breakdown. Where maximum field intensity is not necessary and lower voltages can be applied, the ionizing occurs in clean gas streams; or during other conditions not producing serious buildup on the surface, cleaning or flushing is, of course, not required. Also, intermittent cleaning may be used.

The inner electrode design introduces large amounts of current (ions) by corona discharge due to the intense field close to the electrode surface. The electrode design also maintains a concentrated field region all the way to the venturi throat wall 5, but at a sharply decreasing magnitude. This concentrated residual field holds the space charge on this path in its migration to the wall and is responsible for the field amplification. The smoothly curved, generally radial periphery of the inner electrode causes the space charge to expand circumferentially in the throat, reducing the ion density near the outer wall to reduce potential spark breakdown. The high venturi velocity tends to diffuse the ion concentration axially in the throat near the venturi throat wall where the strong electric fields are decayed. This adds further stability by expanding the space charge region in the direction of flow, thereby decreasing the field gradient between the space charge region and venturi throat wall 5. This effect is maximized at venturi throat velocities of 50 fps and above. In addition, turbulence at these high velocities may also provide stability by mechanically disrupting the mechanism which causes spark breakdown.

To maintain the corona and, hence, the performance of the charging unit from contamination and degradation, the high-voltage electrode 4 is isolated from other leakage paths besides the corona discharge. As best shown in FIG. 2, a probe 10 supports the electrode 4 in its proper location in the venturi and provides high resistance to electrical leakage both internally and on its surface. Although not shown, the probe can be moved axially or laterally if desired. The resistance is provided between the electrode and the hard support structure 12 of the probe in the upstream duct 1. Surface resistance is improved by providing a series of clean air bleeds 14 which are continuous slots (0.030 inches) around the circumference of the probe just upstream of the electrode 4. Clean air, provided by an outside supply 15, is fed through the probe body and passes out these slots at high velocity. This action maintains a positive high-resistance path that the surface leakage would have to "bridge" to short the high-voltage electrode 4 to ground.

Figure 3:
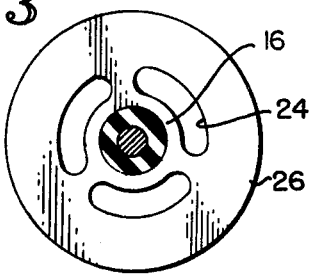
FIG. 3 is a transverse section taken along the line 3—3 of FIG. 2.

The probe body includes a high-voltage cable 16 supported by dielectric hubs 18 which secure the probe via support structure 12 to the duct 1. The upstream end of the probe body is contained in a closed shroud 20 and the downstream portion of the probe is contained in a hollow, corrugated cover 22. Openings 23 allow passage of the air axially to a plurality of spaced rings 26, each with corresponding slots 24 (FIG. 3). The spacing forms the series of continuous slots 14 for bleeding the air as mentioned above.

Electrode 4 also has slots 24 which allow air flow downstream of the electrode. The rings and electrode disc are secured to the cable 16 by a bolt 28 fitted in a nose 30. The nose and clean air from the downstream side of the electrode prevent stagnation of charged contaminants downstream of the disc and prevent deposition of the charged particles on the surface of the electrode 4.

The venturi throat wall 5, because of contaminant buildup, is kept smooth and reasonably clean for a short distance of several times the corona gap $R_3$. This assures that disturbances in the corona from the outer electrode surface, such as contaminant buildup, will be eliminated. This cleaning can be accomplished in several ways; one technique is shown in FIGS. 1 and 2. Water or a similar fluid is injected by an external pump 32 in a smooth layer on the surface of the converging cone section of the venturi wall 5. The angle of convergence phi of the venturi is held at about 12.5° half angle to minimize turbulent flow effects. The venturi in use is pointed in a downward direction and the water film is accelerated as it approaches the throat, both from gravity and friction with the moving gases. The point of water injection is about 1.5 electrode gap $R_3$ lengths line-of-sight upstream from the electrode 4. The expansion of the downstream divergent cone of the venturi is less than 3.5°, again to minimize effects from flow separation. The radius $R_O$ that forms the transition between these angles should be no smaller than about 2 inches. Water injection is accomplished by a thin (0.010–0.025 inch), continuous slot 40 formed by a surface 41 on the circumference of the converging cone with a nozzle direction beta of about 12.5° to the side wall of the venturi. Half angle as used herein is defined as one half the angle between the sidewalls of a converging cone or equal to the angle of one sidewall with respect to a longitudinal axis of the cone. The action of the water on the wall of the venturi maintains a smooth, clean surface without degrading corona performance for velocities of gas flow up to about 75 fps. Water consumption varies with venturi size and ranges from 0.2 to 2 gpm/1000 acfm for 5 to 50 inches venturi diameters.

Water is prevented from migrating upstream along the venturi wall by providing an inwardly directed band or deflector 42 insulated from the cooler water. The water from pump 32 is directed under pressure tangentially into a housing 44 and leaves the housing through slot 40 in an axial direction to minimize spiralling of the water as it passes the throat.

To develop the intense corona and sustain highly efficient, stable performance, the key elements in the units must be optimized. The discharge electrode radius $r$ is cut on the outer periphery of the disc 4 contained by the probe. For best performance, based on present experimental data, this radius should be designed such that the ratio of electrode gap $R_3$ to the discharge electrode radius $r$ is about 100:1. If the ratio is set below 50:1, sparking will occur at low applied voltage, yielding a low operating current and field. If the ratio exceeds 200:1, the electric field contribution in the gap is reduced, which results in higher operating current to maintain the high fields. The radius $R_O$ (the venturi wall curvature radius) should be set no less than a ratio 50:1 with the discharge electrode radius $r$. Smaller radii will induce sparking at lower applied voltages. The diameter of the probe 10 and, hence, the overall diameter of the discharge electrode disc 4, should be set such that the probe occupies around 10% of the cross-sectional area of the venturi throat. A practical minimum is 5%; a probe occupying a smaller percentage of the Venturi throat causes an increase in discharge electrode surface power density. More importantly, smaller values also increase the electrode gap for constant flow capacity of the unit, thereby increasing power supply voltage requirements significantly. Values greater than 10% increase size of the venturi and probe cost and increase probe isolation air bleed requirements and, hence, operational cost. With these electrode geometries, typical high-voltage requirements are such that an average field of about 18–20 kv/cm can be maintained across the electrode gap $R_3$ at standard atmospheric conditions and zero velocity. Standard atmospheric conditions are assumed for all field values and comparisons with prior art field values throughout this description. With venturi velocities about 50 fps, the field can be increased to about 26–28 kv/cm without sparking.

Several important functions occur in the highly intense corona region of the charging unit. The suspended contaminants are field charged by the strong applied fields and ion impaction in the high ion-dense region within the electrode gap $R_3$. It is presumed that the diffusion charging mechanism has minor contribution here on the fine particles due to the short residence time of the particles in the corona. There will be a slight displacement of the particles outward radially as they become charged and migrate in the stong fields of the corona. The amount of this displacement will vary with size of the particle so some mixing, impaction and possible agglomeration can occur. This is seen as a minor effect in view of the thermal agitation and flow turbulence present. In the case of liquid aerosols, however, the effects of strong applied fields (greater than 10 kv/cm), high temperatures and turbulent mixing, cause significant agglomeration to occur, and this effect has been witnessed downstream of the corona. This can be of great benefit in the collection of fine aerosols as particles agglomerate and "grow" to larger, more easily collected sizes.

Velocity of the gases through the highly charged corona area affects the charging efficiency of the system. Above about 50 fps, the space charge region of the field becomes axially spread by the gases to reduce the possibility of spark breakdown, that is, greater stability of the corona is achieved. With the increases in velocity, however, the advantage of increased stability begins to become offset by the disadvantage of the shorter resident time of the contaminants in the field, and thus a reduction in charge on the particles, and increased disruption of the water film on the outer electrode wall if water cleaning is used. Up to about 125 fps, there is a gain in stability of the corona, but with a decrease in charging efficiency. For one system tested, the maximum charge on the particulate appears to occur at 100 fps. To a great extent, however, gas velocity must be a trade-off between the capacity needed for efficient operation of the industrial gases being cleaned, electrode voltage requirements and venturi wall cleaning capability.

Figure 6:
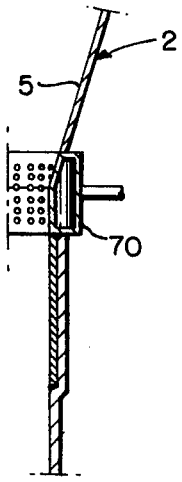
FIG. 6 is a fragmentary, diametrical section of the throat of a modified venturi wall.

A second method of venturi wall cleaning is illustrated in FIG. 6. In this embodiment, a perforated or porous air bleed section 70 is provided at the venturi throat to provide an air film over the downstream venturi wall rather than water film. Downstream of the air bleed section 70 for a distance of several electrode gap $R_3$ lengths, the venturi wall surface is coated with a material of high electrical resistivity for providing electrical isolation of the particles deposited in this area. Gas stream erosion limits the thickness of the deposition to permissible levels.

Still another method is the use of aerosol mist to isolate the water or air film from the disc electrode electric field. In effect, the electric field will not see all the turbulence of the venturi wall cleaning film caused by increased contaminated gas velocity through the venturi because of the mist over the film. As a result, the film disruption will be less likely to create a spark breakdown of the corona discharge.

Still another method is to vibrate or shock the wall to intermittently or continuously dislodge the contaminants before buildup.

The suspended particulate contaminants having passed through the venturi section are highly charged, of like polarity and are migrating to the outer venturi wall 5 downstream of the corona. Deposition on the wall which occurs is minor and represents only those particles travelling near the wall on their original trajectories. Since the applied field in this region is primarily of the space charge element and, therefore, the migration velocities are low in comparison to stream velocities, the bulk of the particles remain in the stream for considerable distances. At least two forms of collection of these highly charged, suspended particulates can be employed.

One technique for collecting the charged particles is a conventional electrostatic precipitator. Another technique is a wet scrubber 50 to be described. The gas contaminant charging section of the venturi is directly attached to the throat 52 of the venturi scrubber 50. In general, the design velocity of the charging venturi is consistent with the desired velocity in the scrubber venturi such that the charging section divergent cone angle is set at about 0°. The charged particle-laden gases pass through the scrubber venturi with the particles collected onto water drops by impaction and interception enhanced by the electrostatic forces. Water enters the venturi scrubber in a conventional manner as through a continuous slot 54 and is atomized by the gas stream. The water droplets are oppositely charged to the particles by induction because the atomization process occurs in a residual field region. Preferably, at low venturi velocities (below about 75 fps), the injection point should be at least two gaps $R_3$ downstream of the disc 4 to prevent premature spark breakdown. At higher venturi velocities, greater separation distances are required due to ions drifting downstream of the corona which tend to foul the induction process by undesirably charging the water droplets with the same polarity as the charged particles. By extending bolt 28, the induction charging field is increased axially, even though the separation distance between the electrode 4 and the injection point is increased. This also provides for a cylindrical field emitting from the bolt which drives the ions toward the outer wall 5 downstream of the electrode 4.

The collection efficiency of a conventional venturi scrubber depends upon the inertial impaction of particles on water droplets The impaction is accomplished by high relative velocity of the contaminated air stream and water droplets injected at low velocity. The submicron sized particles escape impaction by following the slip stream around the water drops instead of impacting. (An example is illustrated schematically in FIG. 1A). This is due to their high aerodynamic drag-to-inertia ratio. Particle bounce and rebound also become important considerations in cases of marginal impaction and interception energies. Particles with low impaction energies fail to penetrate the water droplet due to surface tension effects.

Particles containing a high ($\sim$10kv/cm surface gradient) electrostatic charge and with induced charge on the water droplets, as in this invention, have an attractive force between the charged particles and water droplets sufficient to significantly effect their impaction trajectories, as shown schematically in FIG. 1B. This effect results in a substantial improvement in collection efficiency over the basic scrubber efficiency. The impaction improvement effect varies with particle size and the relative velocity between the particles and water droplets.

The sensitivity to particle size is minor with a variation in effect of only + or − 20% when considering 0.1 micron through 10 micron size particles. Since the longer the electrostatic forces have time to act, the more effective they become, lower relative velocities between charged particles and water drop yields a larger improvement effect. Since lower velocities also yield less effective atomization of the scrubber fluid and larger equipment sizes, an optimum velocity range becomes apparent.

Below about 50 fps relative velocity, atomization in the venturi scrubber degrades rapidly; therefore, liquid requirements increase substantially to maintain efficiency. Above 200 fps relative velocity, pressure drop across the system due to water droplet acceleration losses becomes excessive. Therefore, the maximum collection efficiencies of the gas contaminant-charging unit/venturi scrubber collector at minimum energy consumption generally occur with venturi scrubber designs around 125–150 fps in the throat.

One tested embodiment of the invention employed a gap radius $R_3$ of 1½ inches, a disc edge radius *r* of 1/64 of an inch, a peripheral radius $R_1$ of 0.875 inches, a venturi throat radius $R_2$ of 2⅜ inches, a converging sidewall angle phi of 12.5°, and a venturi wall curvature radius $R_O$ of 3–4 inches. The embodiment had a 750 cfm capacity with gas flow of about 120 fps in the scrubber venturi. Typical prior art "scrubber only" collection efficiency of this design is approximately 81% at a 0.5 micron particle size. Collection efficiency is increased to approximately 95% at 0.5 micron size when the gas contaminant-charging unit of this invention is activated. The system at this condition consumes approximately 7.5 gpm/1000 acfm of water, 150 watts/1000 acfm charging unit power and has 4 inches of water system pressure drop.

A second tested embodiment employs gap radius $R_3$ of 2.15 inches, an edge curvature of about a radius *r* of 1/64 of an inch, a peripheral radius $R_1$ of 0.875 inch, a venturi throat radius $R_2$ of 3.03 inches, a converging sidewall angle of 15°, and a venturi wall curvature radius $R_O$ of 2 inches. The embodiment had a 1,000 cfm capacity, with gas flow of about 150 fps in the scrubber venturi. The typical prior art "scrubber only" collection efficiency of this design is approximately 94.6% at a 1.25 micron particle size. Collection efficiency is increased to approximately 97.5% at 1.25 micron size when the gas contaminant-charging unit of this invention is activated. The system at this condition consumes about 6 gpm/1000 acfm of water, 150 watts/1000 acfm charging unit power and has 5 inches of water pressure drop.

Typical corona ionizing apparatus in the prior art have generally been limited to field intensities of 5–10 kv/cm. With the ionizer of this invention using the optimum electrode design and fluid velocity past the electrodes, field intensities up to 30 kv/cm are obtainable without spark breakdown.

Figure 8:
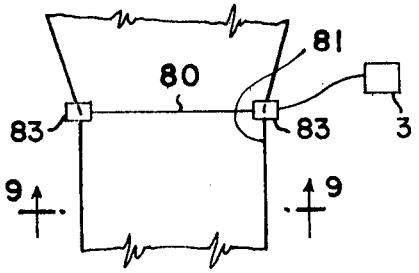
FIG. 8 is an axial section of a form of ionizer illustrating the principles of a second invention.
Figure 9:
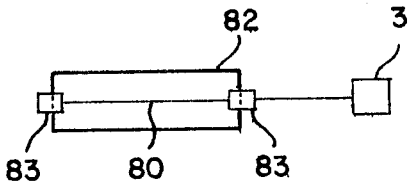
FIG. 9 is a transverse section of the embodiment of FIG. 8.
Figure 10A:
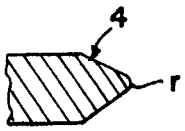
FIGS. 10A–10D are various edge radius shapes.
Figure 10B:
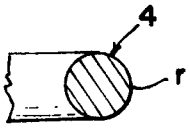
Figure 10C:
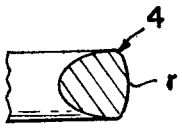
Figure 10D:
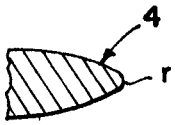

One incidental advantage of the invention occurs from the discovery that the velocity effect which axially diffuses the space charge to assist in reducing potential breakdown can be used advantageously alone with more conventional precipitation designs to greatly increase their operating field strength. For example, FIGS. 8 and 9 illustrate a known ionizer using a single wire electrode 80 placed transversely across a venturi throat 81 of a rectangular duct 82. Insulators 83 isolate the wire from the duct in a known manner. The wire is connected to power supply 3 as in the preferred embodiment.

Normally, a single wire-plate ionizer must be operated at low applied voltages such that the average field between the electrodes does not exceed about 10 kv/cm before spark breakdown. Velocities are kept low, at about 10 fps. A typical example of this operation is a home electrostatic air cleaner. Using the higher velocities of about 50 fps of this invention, average field intensities of above 10 kv/cm can be obtained without spark breakdown since the velocity sweeps the excess space charge downstream out of the most intense field.

By the same mechanism, multiple transverse wire precipitators having transverse wires spaced axially along a duct are also limited to low voltages, even with higher fluid velocities since the displacement of ions from one wire region will be then exposed to the next downstream field region.

Multiple transverse, axially spaced wires can be used, of course, if spaced axially sufficient distances apart to allow ions from each next upstream wire to migrate to the outer electrode (duct) prior to entering the ionizing field of the downstream wire in order to allow the fields generated by the wires to expand axially. Similarly, if multiple, axially spaced discharge electrodes 4 are used in the embodiment illustrated in FIG.1, the discharge electrodes 4 must be spaced axially a sufficient distance apart to allow the electrostatic fields to expand axially in a wedge-shaped configuration.

Figure 4:
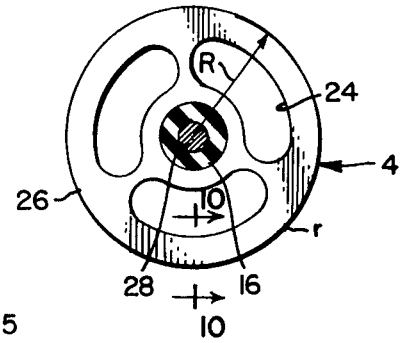
FIG. 4 is a transverse section taken along the line 4—4 of FIG. 2.
Figure 5:
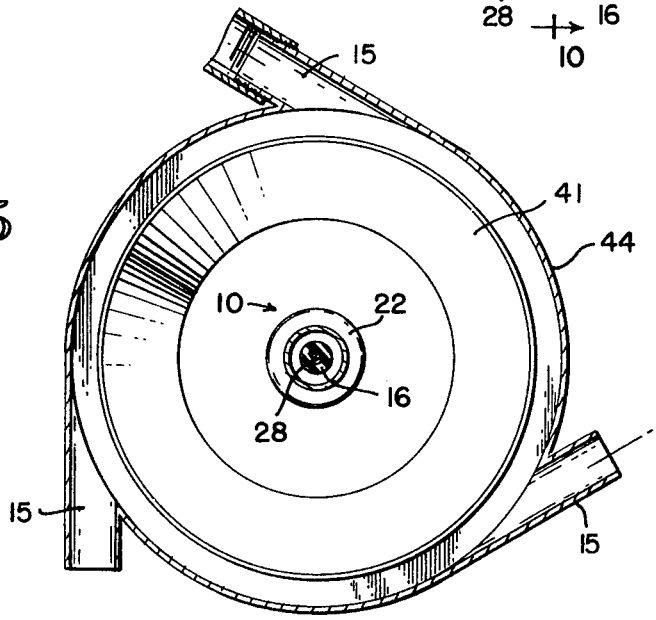
FIG. 5 is a transverse section taken along the line 5—5 of FIG. 2.
Figure 11:
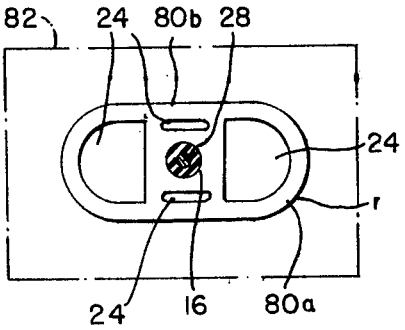
FIG. 11 is another embodiment of an ionizer.
Figure 12:
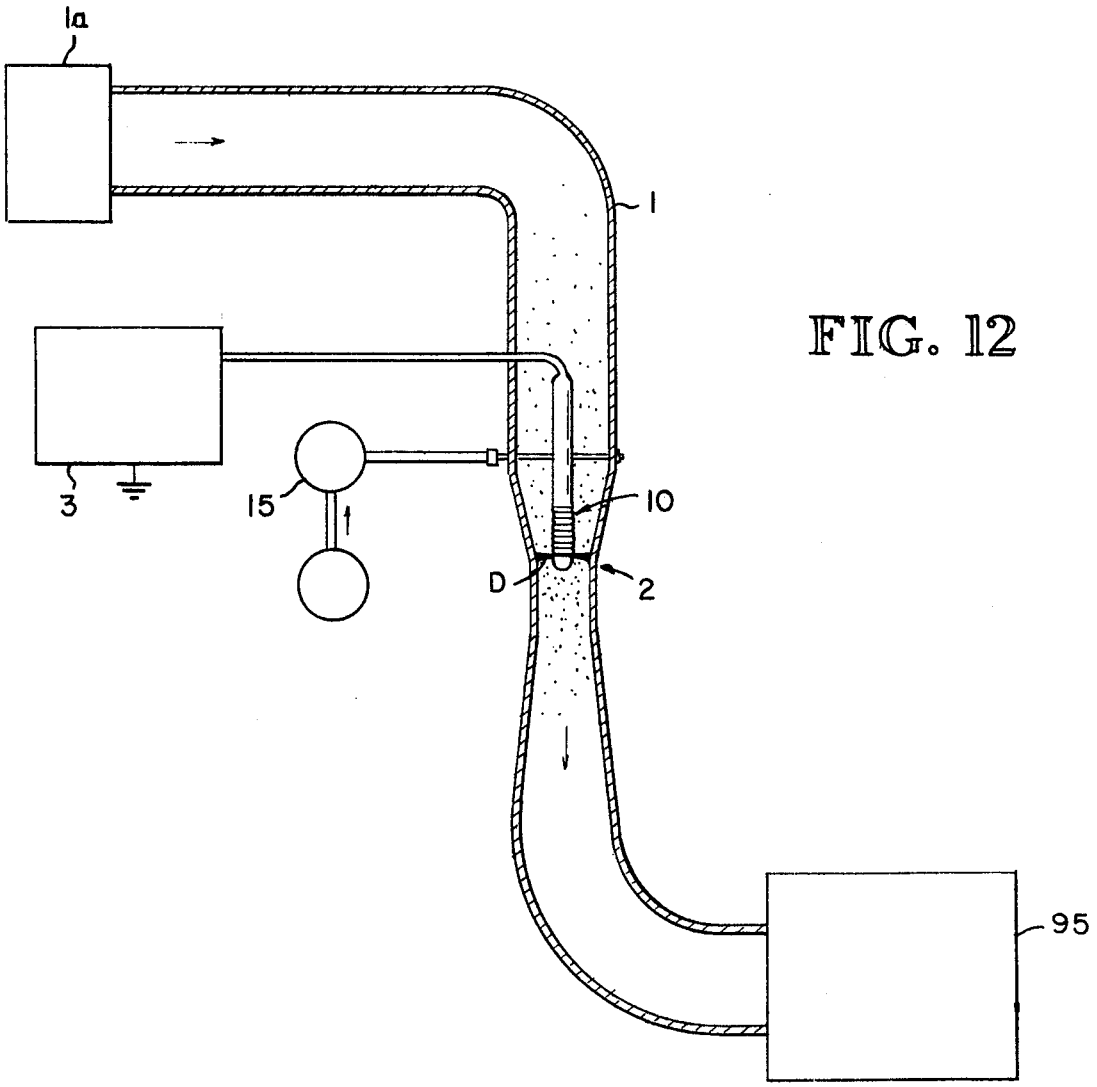
FIG. 12 is a longitudinal section of the ionizer employing a conventional precipitator for removing particles which have been charged by the inventive apparatus.

FIG. 11 illustrates another embodiment having electrode ends 80*a* of a radial configuration and central electrodes 80*b* of linear configurations. Preferably, the duct 82 is again rectangular but could be curved to match the electrode. Air ports 24 are provided as shown in FIGS. 3-5. All of the shapes of FIGS. 10A-10D can, of course, be used for the edge radius *r*. This electrode configuration will perform most like the wire-plate electrode of FIGS. 8 and 9 but also will obtain some of the advantages of the more radial type electrodes. Another embodiment of the invention is illustrated in FIG. 12. The ionizer is as described with respect to FIG. 1, and a conventional precipitator 95 is placed downstream of the ionizer to remove particles charged by the ionizer.

The embodiments of the invention in which a particular property or privilege is claimed are defined as follows:

1. An apparatus for removing contaminants from a gas, comprising:

a tubular outer electrode adapted to conduct said gas therethrough;

a generally planar inner electrode having a perimeter generally corresponding to the shape of said outer electrode, said inner electrode being positioned within said outer electrode and defining an electrode gap therebetween, said inner electrode having a smoothly curved peripheral surface converging outwardly from the center of said electrode when viewed in axial cross section said inner electrode being the sole corona current emitting structure within a sufficient distance from said inner electrode to allow an axial wedge-shaped expansion of the field to the outer electrode;

means for applying a high voltage across said electrodes for creating a corona discharge high intensity electrostatic field within said electrode gap;

means for cleaning the surface of said outer electrode;

means for moving said gas in a stream axially through said electrode gap thereby charging contaminants in said gas; and means for collecting said charged contaminants.

2. The apparatus of claim 1 wherein said outer electrode has a generally cylindrical configuration, and said inner electrode peripheral surface is curved in the shape of a parabola when viewed in axial cross section.

3. The apparatus of claim 1 wherein said outer electrode has a generally cylindrical configuration, and said inner electrode is generally disc-shaped.

4. The apparatus of claim 3 wherein the ratio of the transverse width of the electrode gap to the radius of curvature of the peripheral surface of said inner electrode when viewed in axial cross section is approximately between 200:1 and 50:1.

5. The apparatus of claim 4 wherein the ratio of the transverse width of the electrode gap to the radius of curvature of the peripheral surface of said inner electrode when viewed in axial cross section is approximately 100:1.

6. The apparatus of claim 1 wherein the surface of said outer electrode is curved away from said inner electrode when viewed in axial cross section, and wherein the ratio between the radius of curvature of said outer electrode surface and the radius of curvature of the periperal surface of said inner electrode when viewed in axial cross section is greater than approximately 50:1.

7. The apparatus of claim 1 wherein said inner electrode is mounted on the downstream end of an axially aligned insulated rigid probe, said probe having a circumferential discharge slot and including means for continuously directing a cleaning gas through said slot and along said probe adjacent the slot thereby preventing buildup of contaminants along the length of said probe upstream of said inner electrode.

8. The apparatus of claim 1 wherein the ratio of the transverse area occupied by said inner electrode to the transverse area within said outer electrode is greater than 1:20.

9. The apparatus of claim 1 wherein said collecting means is a wet scrubber having means on the outer electrode spaced axially from the inner electrode toward the collecting means and axially downstream of said inner electrode for introducing scrubbing liquid into said gas stream axially downstream of said inner electrode such that said liquid is image charged by said charged contaminants thereby attracting said contaminants to said scrubbing liquid for collection by said scrubbing liquid.

10. The apparatus of claim 9 wherein said means for introducing scrubbing liquid into said gas stream includes inlet means located within the residual field region of said electrostatic field for inductively charging the scrubbing liquid by the residual field with a polarity opposite that of the charged contaminants as the scrubbing liquid is introduced.

11. The apparatus of claim 1 wherein said collecting means is an electrostatic precipitator.

12. The apparatus of claim 1 wherein the outer electrode includes a Venturi having a Venturi throat, a converging sidewall upstream of said Venturi throat and a diverging sidewall downstream of said Venturi throat, and wherein said inner electrode is placed within said Venturi.

13. The apparatus of claim 12 wherein said inner electrode is within the throat of said Venturi.

14. The apparatus of claim 12 wherein said means for moving said gas axially through said electrode gap conveys said gas through said electrode gap at a velocity greater than 50 fps and said means for cleaning the surface of said outer electrode includes inlet means for injecting a continuous film of water in the direction of gas flow along the upstream converging sidewall to prevent deposition of contaminants on the surface of said outer electrode, and wherein said upstream converging sidewall is inclined at an angle of approximately 12.5° with respect to the axis of the outer electrode in order to minimize turbulent flow effects such that said continuous film of water flows smoothly along the surface of said outer electrode sidewall.

15. The apparatus of claim 14 wherein said water is injected along said converging side wall at a distance upstream of said inner electrode of about one electrode gap width such that water is present along the walls of the outer electrode where corona current is deposited.

16. The apparatus of claim 14 wherein the diverging angle of said downstream sidewall is less than 3.5° thereby minimizing turbulent flow effects on the water flowing along the surface of said outer electrode sidewall.

17. The apparatus of claim 1 wherein said means for cleaning the surface of said outer electrode includes means for injecting a continuous layer of air along said outer electrode to prevent deposition of contaminants thereon.

18. The apparatus of claim 17, said means for injecting a continuous layer of air along said outer electrode includes a circumferential air bleed.

19. The apparatus of claim 18, including a resistive material layer on the outer electrode sidewall downstream and adjacent said air bleed.

20. The apparatus of claim 1 wherein said means for applying a high voltage places a voltage between said inner and outer electrodes greater than 10 Kv for each cm. of said electrode gap when air at approximately standard temperature and pressure is within said electrode gap.

21. The apparatus of claim 1, said means for cleaning the surface of said outer electrode includes means for creating an aerosol mist between the inner electrode and the outer electrode to clean the outer electrode.

22. The apparatus of claim 1 wherein said inner electrode is supported for at least one and one quarter electrode gaps axially of said inner electrode by a passive, non-corona generating structure.

23. An apparatus for ionizing a gas, comprising:

a tubular electrode adapted to conduct said gas therethrough;

a generally planar inner electrode having a perimeter generally corresponding to the shape of said outer electrode, said inner electrode being positioned within said outer electrode and defining an electrode gap therebetween, said inner electrode having a smoothly curved peripheral surface converging outwardly from the center of said electrode when viewed in axial cross section, said inner electrode being the sole corona current emitting structure within a sufficient distance from said inner electrode to allow an axial wedge-shaped expansion of the field to the outer electrode;

means for applying a high voltage across said electrodes to create a corona discharge high intensity electrostatic field within said electrode gap; and means for moving said gas axially through said electrode gap thereby ionizing said gas.

24. The apparatus of claim 23 wherein said outer electrode has a generally cylindrical configuration, and said inner electrode peripheral surface is curved in the shape of a parabola when viewed in axial cross section.

25. The apparatus of claim 23 wherein said outer electrode has a generally cylindrical configuration, and said inner electrode is generally disc-shaped.

26. The apparatus of claim 25 wherein the ratio of the transverse width of the electrode gap to the radius of curvature of the peripheral surface of said inner electrode when viewed in axial cross section in approximately between 200:1 and 50:1.

27. The apparatus of claim 26 wherein the ratio of the transverse width of the electrode gap to the radius of curvature of the peripheral surface of said inner electrode when viewed in axial cross section is approximately 100:1.

28. The apparatus of claim 25 wherein the surface of said outer electrode is curved away from said inner electrode when viewed in axial cross section, and wherein the ratio between the radius of curvature of said outer electrode surface and the radius of curvature of the peripheral surface of said inner electrode when viewed in axial cross section is greater than approximately 50:1.

29. The apparatus of claim 23 wherein the ratio of the transverse area occupied by said inner electrode to the transverse area within said outer electrode is greater than 1:20.

30. The apparatus of claim 23 wherein the configuration of said outer electrode is a Venturi having a Venturi throat, a converging sidewall upstream of said Venturi throat and a diverging sidewall downstream of said Venturi throat, and wherein said inner electrode is placed within said Venturi.

31. The apparatus of claim 30 wherein said inner electrode is within the throat of said Venturi.

32. The apparatus of claim 23 wherein said means for applying a high voltage places a voltage between said inner and outer electrodes greater than 10 Kv for each cm. of said electrode gap when air at approximately standard temperature and pressure is within said electrode gap.

33. The apparatus of claim 23, wherein said inner electrode is supported for at least one and one quarter electrode gaps axially of said inner electrode by a passive, non-corona generating structure.

34. An apparatus for charging contaminants in a contaminant laden gas, comprising:

a tubular outer electrode adapted to conduct said gas therethrough;

an inner electrode positioned within said outer electrode, said inner electrode including a planar member having a perimeter generally corresponding to the shape of said outer electrode and defining an electrode gap therebetween and a smoothly curved peripheral surface converging outwardly from the center of said electrode when viewed in axial cross section;

means for clearing the surface of said outer electrode, power supply means connected between said inner and outer electrodes for generating a corona discharge between said planar member and said outer electrode;

said planar member being the sole corona generating element of said inner electrode to allow said corona discharge to expand axially of said outer electrode to form a generally wedge-shaped electrostatic field between said planar member and said outer electrode thereby charging contaminants in said gas flowing through said electrode gap.

35. An apparatus for ionizing a gas, comprising:

a tubular outer electrode adapted to conduct said gas therethrough;

an inner electrode positioned within said outer electrode, said inner electrode including a planar member having a perimeter generally corresponding to the shape of said outer electrode and defining an electrode gap therebetween and a smoothly curved peripheral surface converging outwardly from the center of said electrode when viewed in axial cross section; and power supply means connected between said inner and outer electrodes for generating a corona discharge between said planar member and said outer electrode;

said planar member being the sole corona generating element of said inner electrode to allow said corona discharge to expand axially of said outer electrode to form a generally wedge-shaped electrostatic field between said planar member and said outer electrode thereby ionizing said gas flowing through said electrode gap.

* * * * *